US007360601B2

(12) United States Patent
See

(10) Patent No.: US 7,360,601 B2
(45) Date of Patent: Apr. 22, 2008

(54) SUBMERSIBLE WELL PUMP INSTALLATION PROCEDURE

(75) Inventor: Boon Sun See, Geylang Bahru (SG)

(73) Assignee: Vetco Gray Inc., Houston, TX (US)

( * ) Notice: Subject to any disclaimer, the term of this patent is extended or adjusted under 35 U.S.C. 154(b) by 194 days.

(21) Appl. No.: 11/068,541

(22) Filed: Feb. 28, 2005

(65) Prior Publication Data

US 2005/0189116 A1 Sep. 1, 2005

Related U.S. Application Data

(60) Provisional application No. 60/548,359, filed on Feb. 26, 2004.

(51) Int. Cl.
*E21B 29/12* (2006.01)

(52) U.S. Cl. ..... 166/339; 166/349; 166/351; 166/368

(58) Field of Classification Search ..... 166/338, 166/339, 340, 348, 349, 351, 368, 68.5, 85.3, 166/382, 75.14
See application file for complete search history.

(56) References Cited

U.S. PATENT DOCUMENTS

| | | | | | |
|---|---|---|---|---|---|
| 3,847,215 | A * | 11/1974 | Herd | 166/337 |
| 3,871,449 | A * | 3/1975 | Ahlstone | 166/183 |
| 3,945,700 | A * | 3/1976 | Didier | 439/589 |
| 4,003,428 | A * | 1/1977 | Zehren | 166/341 |
| RE30,070 | E * | 8/1979 | Sizer et al. | 166/72 |
| 4,738,599 | A * | 4/1988 | Shilling | 417/400 |
| 4,749,341 | A * | 6/1988 | Bayh, III | 417/360 |
| 4,830,113 | A * | 5/1989 | Geyer | 166/369 |
| 4,995,458 | A * | 2/1991 | Garbett | 166/85.3 |
| 5,025,864 | A * | 6/1991 | Nobileau | 166/348 |
| 5,051,103 | A * | 9/1991 | Neuroth | 439/192 |
| 5,544,706 | A * | 8/1996 | Reed | 166/379 |
| 5,655,606 | A * | 8/1997 | Ferguson | 166/382 |
| 5,751,895 | A * | 5/1998 | Bridges | 392/306 |
| 5,784,530 | A * | 7/1998 | Bridges | 392/306 |
| 6,202,743 | B1 * | 3/2001 | Moore | 166/65.1 |
| 6,302,211 | B1 * | 10/2001 | Nelson et al. | 166/348 |
| 6,530,433 | B2 * | 3/2003 | Smith et al. | 166/387 |
| 6,719,044 | B2 * | 4/2004 | Ford et al. | 166/85.3 |
| 6,945,325 | B2 * | 9/2005 | Ford et al. | 166/85.3 |

FOREIGN PATENT DOCUMENTS

| | | | |
|---|---|---|---|
| GB | 2359317 | * | 8/2001 |

* cited by examiner

*Primary Examiner*—Thomas A Beach
(74) *Attorney, Agent, or Firm*—Bracewell & Giuliani LLP

(57) ABSTRACT

A method of installing an electrical pump assembly in a subsea wellhead member avoids having to run the pump assembly through the wellhead member after removing the wear bushing. The operator first lowers the pump assembly on a string of tubing at least through the wear bushing while deploying the power cable alongside the tubing. He then connects a retrieval tool to the tubing, inserts the power cable into a slot in a side wall of the retrieval tool, and lowers the retrieval tool. After engaging the wear bushing, the operator retrieves the wear bushing while taking up the power cable. The operator connects a tubing hanger to the tubing, and lowers the pump assembly again until the tubing hanger lands in the wellhead member.

19 Claims, 5 Drawing Sheets

SUBMERSIBLE WELL PUMP INSTALLATION PROCEDURE

CROSS REFERENCE TO RELATED APPLICATION

This application claims priority to Provisional Application No. 60/548,359, filed Feb. 26, 2004.

BACKGROUND OF THE INVENTION

A subsea well of the type concerning herein has a production tree located subsea near the sea floor. The tree lands on a wellhead housing located at the upper end of the well. In one type of well, a tubing hanger lands in the tree, and production tubing suspended from the tubing hanger extends into the well. In another type of well, the tubing hanger lands in the wellhead housing, and the tree is installed on the wellhead housing after running the tubing.

Both the tree in the first type and the wellhead housing in the second type have bores containing smoothly polished sealing surfaces. Wear bushings are installed in the bores to avoid damage to the sealing surfaces before installing the tubing hanger. The wear bushing provides protection against damage from drill pipe and other tools, and is removed before installing the tubing hanger.

Many subsea wells produce with natural pressure, but others have insufficient pressure initially or later to flow naturally at adequate rates. Electrical submersible pumps have been installed in surface wells for many years and more recently in subsea wells to pump the well fluid. A typical electrical submersible pump comprises a large electrical motor that secures to the lower end of a centrifugal pump. Normally, the pump assembly is suspended on the production tubing and discharges well fluid into the tubing. A power cable extends from the motor alongside the tubing to the tubing hanger. In the case of a subsea well, the power cable normally terminates at the tubing hanger, and an electrical connection is made between an electrical receptacle on the tubing hanger and a power source on the exterior of the tree.

The wear bushing in the tree or wellhead housing is normally removed prior to running the submersible pump assembly. This removal allows the tubing hanger to land and seal, but it exposes the seal surfaces to possible damage from the pump assembly as it passes through the tree or wellhead housing.

SUMMARY OF THE INVENTION

In this invention, the operator lowers the pump assembly through the wear bushing in the wellhead member while deploying the power cable alongside the conduit. He then connects a retrieval tool to the conduit, inserts the power cable into a slot in a side wall of the retrieval tool, and lowers the retrieval tool and the pump assembly while deploying power cable until the retrieval tool engages the wear bushing. Then, the operator lifts the conduit and retrieves the wear bushing while taking up the power cable. When the wear bushing reaches the platform, the operator disconnects the retrieval tool from the conduit. The pump assembly will still be below the wellhead member sealing surfaces.

In the preferred method, the operator then lowers the pump assembly again by adding more conduit until a desired total length of conduit is reached. While doing so, the operator feeds the power cable through the wear bushing, which is preferably supported on a cradle on the platform. The operator then connects a hanger to the conduit, secures the upper end of the cable to the hanger, and lowers the hanger and the conduit until the hanger lands in the wellhead member.

DETAILED DESCRIPTION OF THE INVENTION

Figure 1:
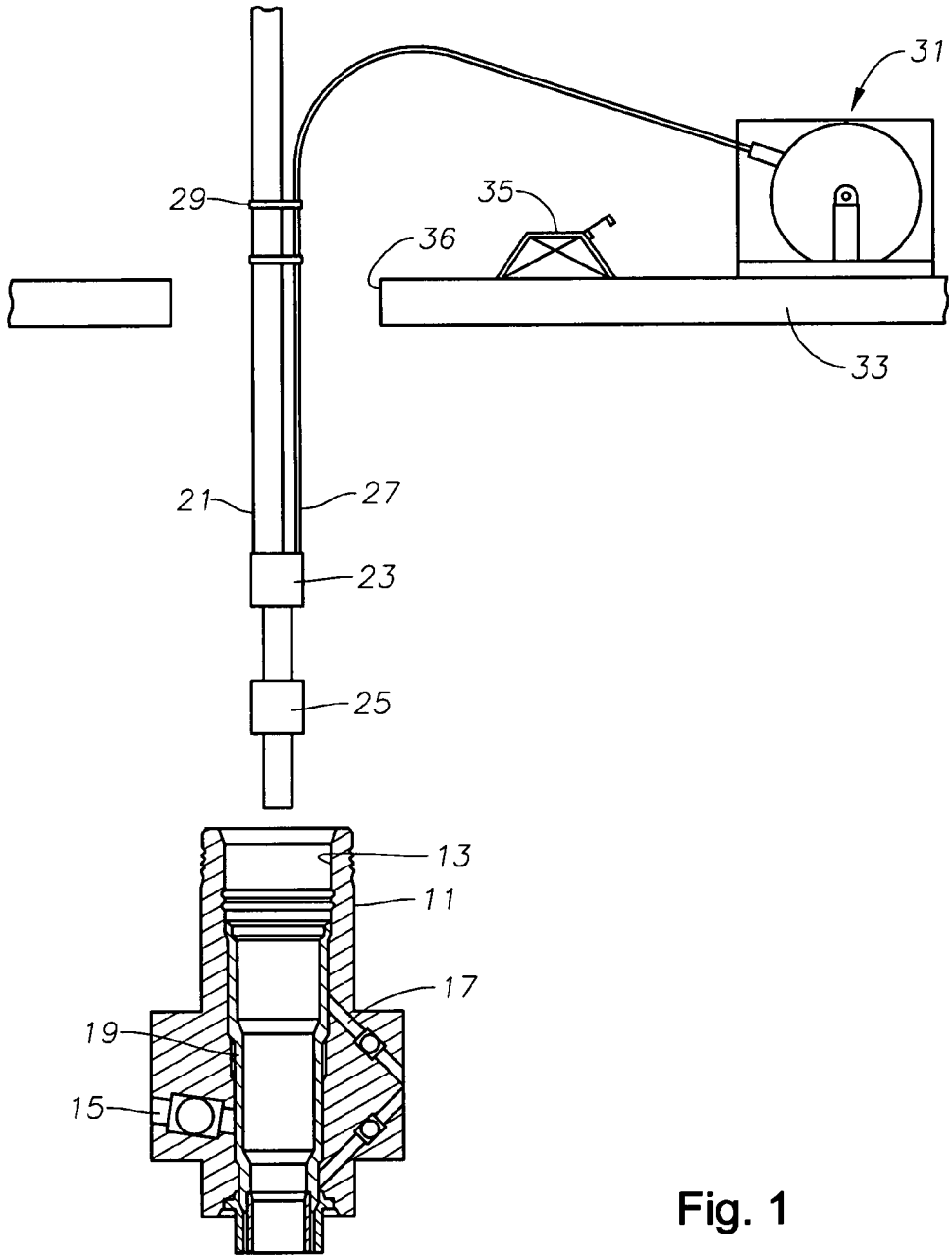
FIG. 1 is a schematic view illustrating a submersible pump being lowered through a Christmas tree containing a wear bushing in accordance with this invention.

Referring to FIG. 1, a conventional wellhead assembly is shown located at a sea floor, the wellhead assembly in this drawing comprising a Christmas tree 11, referred to as a "horizontal" tree, but the invention is applicable to other types of trees also. Tree 11 is located at the upper end of a cased well and has a bore 13 extending through it. A production passage 15 leads laterally outward from bore 13. Tree 11 also has a tubing annulus bypass passage 17 that leads from a lower portion of bore 13 to an upper portion of bore 13.

A bore protector or wear bushing 19 is shown located in bore 13 for protecting the sealing surfaces within bore 13 from damage from tools and equipment being lowered through bore 13. Wear bushing 19 is a metal sleeve that lands on a shoulder in bore 13 and blocks production passage 15 while located within. Wear bushing 19 is conventional and typically has some type of retainer to selectively retain it within bore 13 against upward movement.

FIG. 1 shows a string of conduit, preferably production tubing 21, being lowered into tree 11. Production tubing 21 may be conventional tubing having individual sections approximately 30 feet in length, each having threaded ends that are secured together. Alternately, tubing 21 could be continuous tubing of a type referred to as "coiled" tubing.

A conventional electrical submersible pump assembly 23 is schematically shown located at the lower end of tubing 21.

Pump assembly 23 typically comprises a centrifugal pump and an AC three-phase motor. A packer 25 may be located below or above pump 23. Packer 25 seals to the casing within the well and may be eliminated in some instances. A power cable 27 connects to the motor of pump assembly 23 and extends alongside tubing 21 for supplying power to the motor. Power cable 27 is normally armored cable having three conductors for supplying three-phase AC power. Clamps 29 are secured at selected distances apart from each other alongside tubing 21 to retain power cable 27 with tubing 21.

Figure 5:
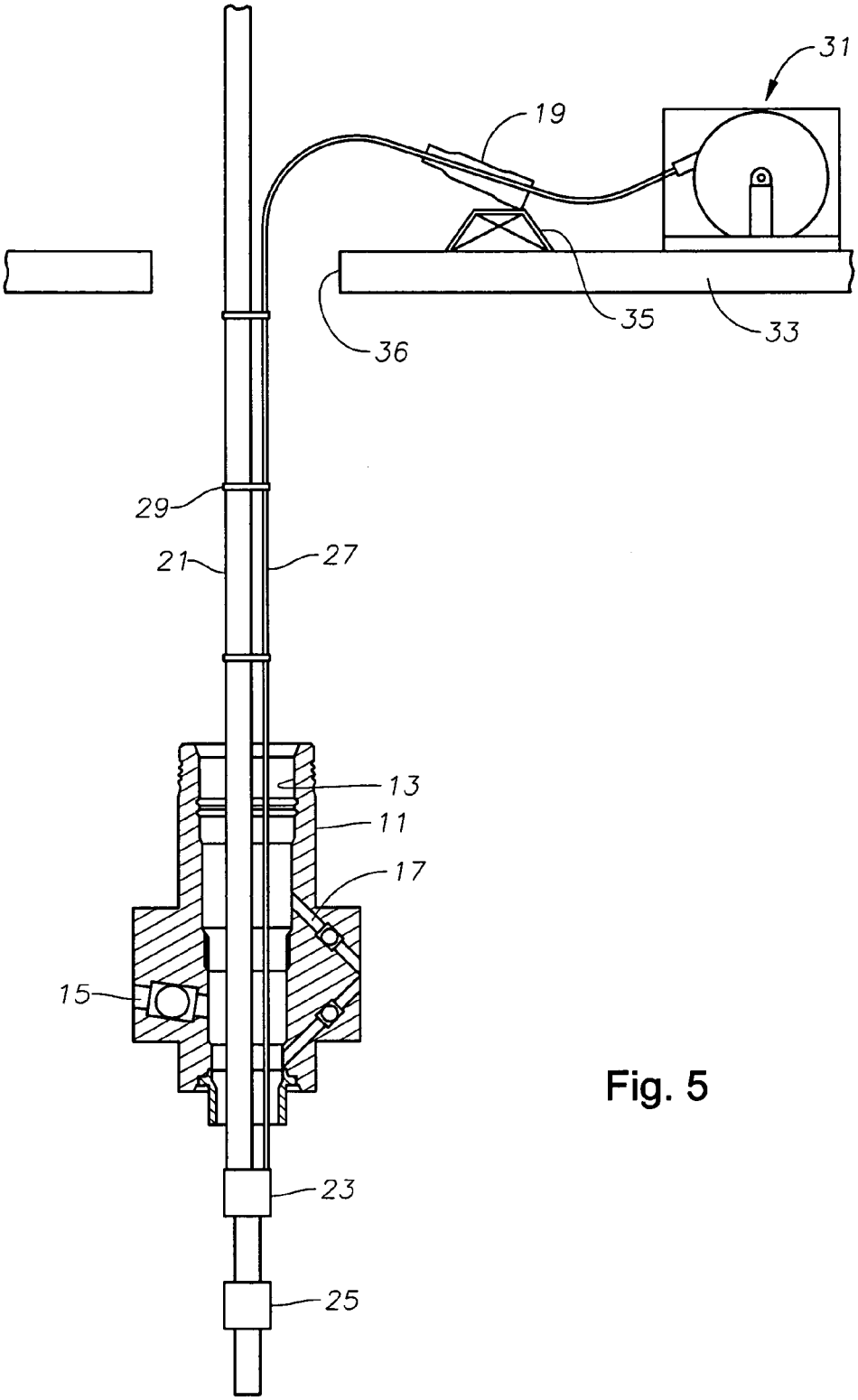
FIG. 5 is a schematic view of the tree and the wear bushing after the wear bushing has been retrieved to the surface.

In FIG. 1, power cable 27 extends to surface platform 33, typically a floating platform, where it is deployed from a large reel 31. In the preferred method, a wear bushing cradle 35 is mounted to platform 33 adjacent opening 36 of platform 33. Wear bushing cradle 35 is a frame that is fabricated for supporting wear bushing 19 in an inclined position once it is retrieved, as shown in FIG. 5. Positions other than inclined are suitable.

Platform 33 has a derrick with a draw works (not shown) that is employed to support the string of tubing 21 as it is lowered into the well. As tubing 21 is lowered into the well, the operator will feed out power cable 27 from reel 31 and will attach clamps 29 at appropriate points along tubing 21. The operator will continue the process until pump assembly 23 is below wear bushing 19 in tree 11. Wear bushing 19 guides pump assembly 23 through tree 11 and prevents pump assembly 23 from damaging sealing surfaces in bore 13. Wear bushing 19 also protects the sealing surfaces from damage by any other equipment previously lowered through tree 11.

Figure 2:
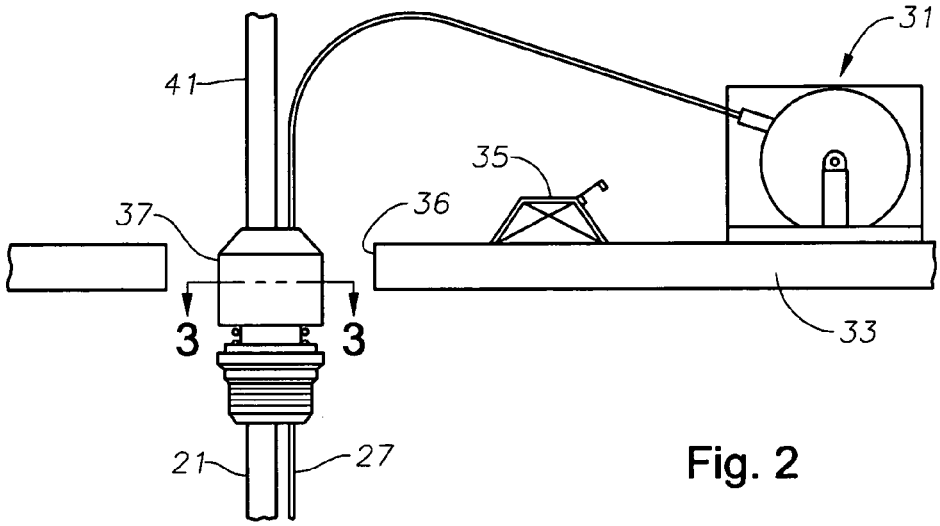
FIG. 2 is a schematic view showing a wear bushing retrieval tool being attached to the upper end of the tubing string after the pump has passed below the tree.

Cable clamps 29 may be too large in cross-section to fit through wear bushing 19. If so, the operator will lower pump assembly 23 below wear bushing 19, but stop before reaching the first cable clamp 29. After pump assembly 23 is below tree 11, the operator attaches a wear bushing retrieval tool 37 to the upper end of the string of tubing 21, as shown in FIG. 2. If the cable clamps 29 were small enough in cross-section to pass through wear bushing 19, the operator could assemble the entire desired total length of tubing 21 before attaching retrieval tool 37.

Figure 3:
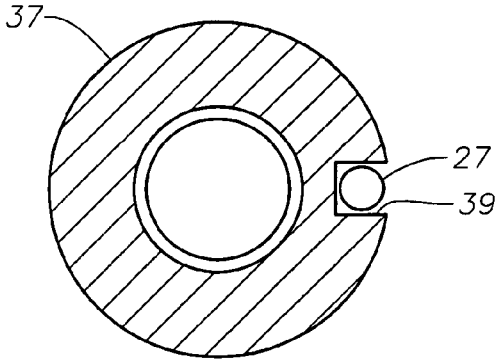
FIG. 3 is a sectional view of the retrieval tool of FIG. 2, taken along the line 3-3 of FIG. 2.

Wear bushing retrieval tool 37 is a conventional type employed to engage wear bushing 19 to retrieve it from tree 11. Wear bushing retrieval tool 37 has engaging members that engage slots or a groove in wear bushing 19 (FIG. 1). Wear bushing retrieval tool 37 is modified as illustrated in FIG. 3 to include an axially extending slot 39 along one side. Slot 39 extends inward from the outer diameter to the inner diameter to receive power cable 27.

While the operator could lower wear bushing retrieval tool 37 on tubing 21, preferably the operator employs drill pipe 41. Drill pipe 41 is the same type used for drilling, is heavier than tubing 21, and is made-up and broken out repeatedly many times during the life. Production tubing 21, on the other hand, is broken out and made up only during certain workover operations. Retrieval tool 37 could be a clamp-type or split-apart tool to facilitate attachment to a tubing string.

Figure 4:
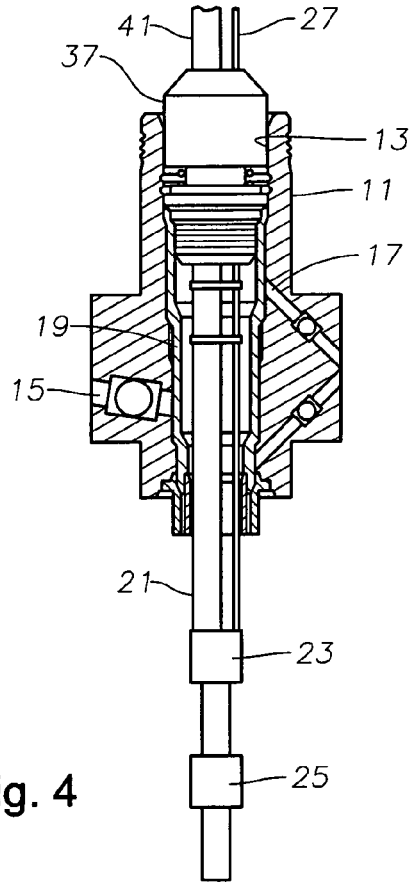
FIG. 4 is a sectional view of the wear bushing retrieval tool in engagement with the wear bushing in the tree of FIG. 1.
Figure 9:
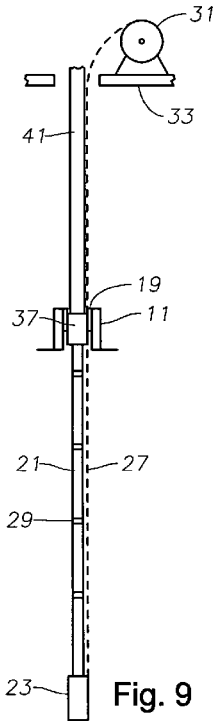
FIG. 9 is a schematic view of the tubing string and pump of FIG. 8 being lowered further, and illustrating the wear bushing retrieval tool in the process of engaging the wear bushing.

The operator lowers tubing 21 and pump assembly 23 farther into the well on drill pipe 41 until retrieval tool 37 lands in tree 11, as illustrated in FIGS. 4 and 9. In this position, the upper end of production tubing 21 will be located at tree 11 and pump assembly 23 will be located deeper, but not yet at its desired setting depth. As pump assembly 23 is lowered on drill pipe 41, more power cable 27 is reeled out. Temporary clamps optionally could be used to secure power cable 27 to drill pipe 41 to transfer the weight of power cable 27 to drill pipe 41. Temporary clamps are not needed if the depth of the water is shallow enough such that the power cable 27 can support its own weight.

Once retrieval tool 37 has landed in wear bushing 19, the operator will retrieve it in a conventional manner. Normally this occurs simply by pulling upward with an over pull sufficient to pull loose the retainer (not shown) that retains wear bushing 19 in bore 13 of tree 11. The operator then begins pulling drill pipe 41 upward back to the surface to retrieve wear bushing retrieval tool 37. While doing so, the operator rolls power cable 27 back onto reel 31. If temporary clamps have been used to attach power cable 27 to drill pipe 41, these clamps will be released as the operator retrieves drill pipe 41.

Figure 10:
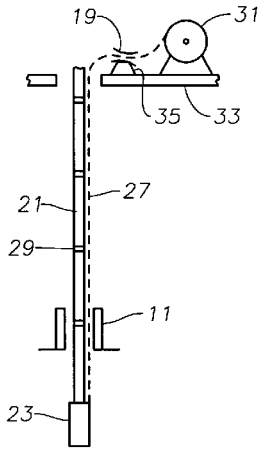
FIG. 10 is a schematic view of the string of tubing and the pump of FIG. 8 being raised in order to retrieve the wear bushing.

When wear bushing retrieval tool 37 reaches platform 33, the operator supports the string of tubing 21 with slips and disconnects retrieval tool 37. In the preferred method, the operator sets wear bushing 19 on cradle 35 with power cable 27 still extending through it as shown in FIGS. 5 and 10. Cradle 35 may support wear bushing 19 at an angle with its lower end inclined upward relative to its upper end at about 30 degrees. This position can vary, however, depending on the placement and diameter of reel 31. The operator then attaches more joints of tubing 21 to lengthen tubing 21 until the total desired length of tubing 21 from tree 11 to the target setting depth has been assembled. During this procedure, as the operator rolls cable 27 out, it passes through wear bushing 19, which serves as a guide. The operator will also attach additional clamps 29 to tubing 21.

Figure 6:
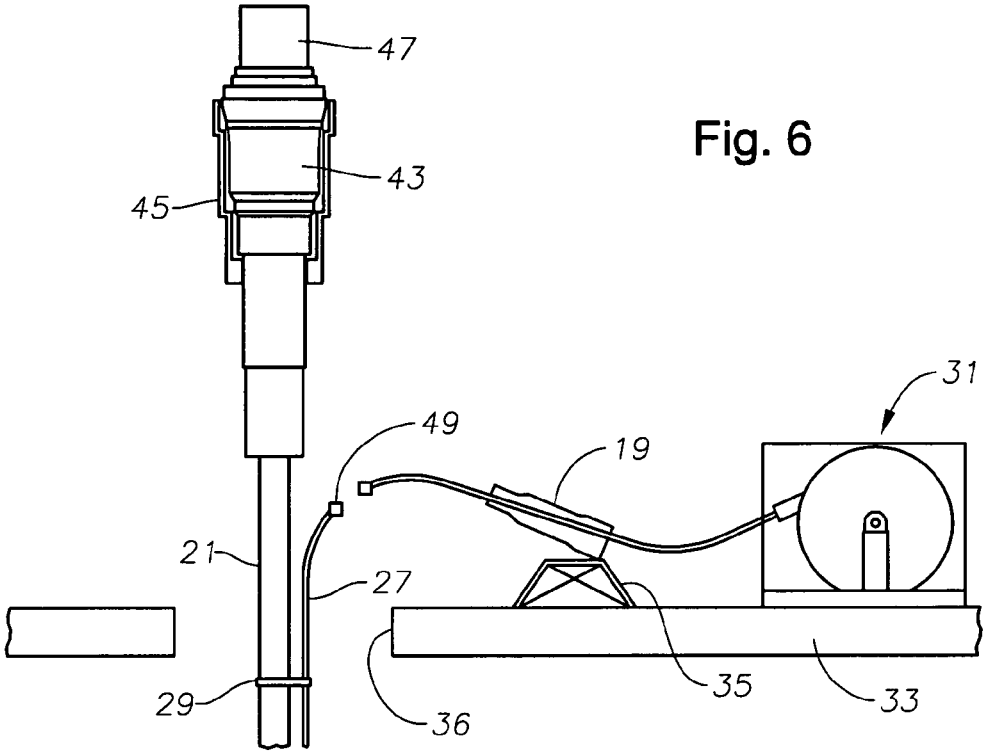
FIG. 6 is a schematic view of a tubing hanger attached to the upper end of the string of tubing after the wear bushing has been retrieved.
Figure 7:
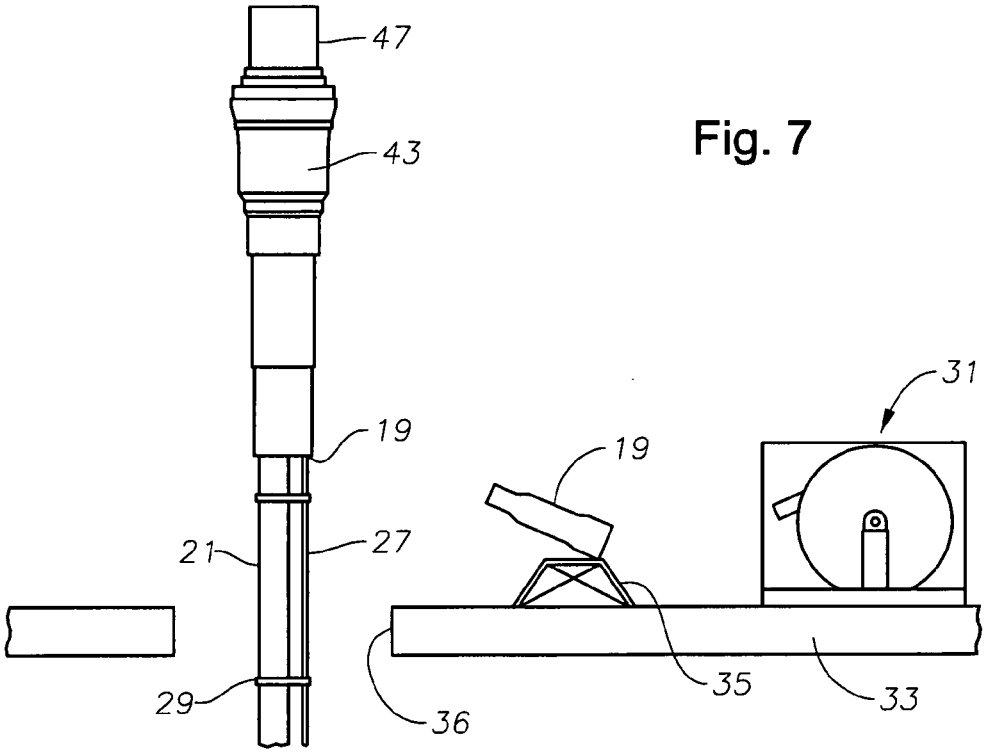
FIG. 7 is a schematic of the tubing hanger of FIG. 6 being lowered into the tree.
Figure 11:
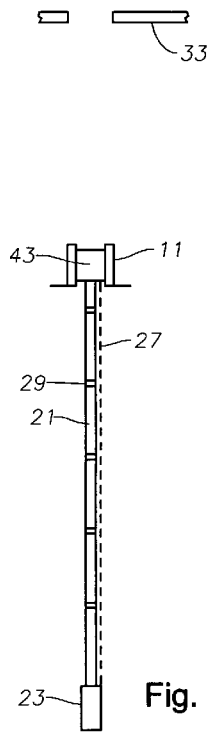
FIG. 11 is a schematic view of the tubing string and tubing hanger installed in the tree.

When the total length of tubing 21 has been reached, the operator attaches a tubing hanger 43 and supports it in the rig rotary table 45. The operator cuts power cable 27, as shown in FIG. 6, forms a penetrator termination 49 on the end, and attaches penetrator termination 49 to a receptacle on the lower end of tubing hanger 43. Once attached, the operator lowers tubing hanger 43 and the string of tubing 21, as illustrated in FIG. 7. Preferably the operator again uses drill pipe 41 to lower the assembly. The operator lands tubing hanger 43 in tree 11, as illustrated in FIG. 11. Electrical power is made up by an electrical connector (not shown) that extends from the assembly of tree 11 into a receptacle provided on tubing hanger 43. The operator disconnects drill pipe 41 from tubing hanger 43 and retrieves drill pipe 41.

Figure 8:
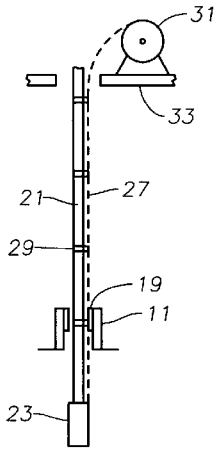
FIG. 8 is a schematic view showing the tubing string and pump being lowered into the well while the wear bushing is located within the tree.

Briefly summarizing the operation, first the operator installs wear bushing 19 in tree 11, as shown in FIG. 1. The operator then lowers pump assembly 23 on tubing 21 as shown in FIG. 8. Wear bushing 19 protects the sealing surfaces within tree 11 from pump assembly 23 as it is lowered through tree 11. Once pump assembly 23 is below tree 11, the operator will retrieve wear bushing 19 on drill pipe 41 as illustrated in FIG. 9. Power cable 27 locates within slot 39 (FIG. 3) in the side of retrieval tool 37 as retrieval tool 37 is lowered and engages wear bushing 19. The operator retrieves wear bushing 19 on drill pipe 41, rolling cable 27 back on to reel 31 during this process.

Once retrieved, the operator places wear bushing 19 on cradle 35 (FIG. 5) and makes up the rest of the total desired length of the string of tubing 21, clamping power cable 27 to tubing 21 during the process. When the total of length of tubing 21 has been made up, the operator cuts cable 27, attaches penetrator 49 (FIG. 6) to tubing hanger 43 and lowers tubing hanger 43 on drill pipe 41 into engagement with tree 11. Drill pipe 41 is then retrieved, leaving the completed assembly as shown in FIG. 11.

The invention has significant advantages. The method avoids the possibility of damage to the seal surfaces in the tree while lowering the pump through the tree bore. The wear bushing is retrieved only after the pump is suspended below the tree bore. The use of a cradle allows the operator to deploy power cable through the wear bushing after it has been retrieved.

While the invention has been shown in only one of its forms, it should be apparent to those skilled in the art that it is not so limited but is susceptible to various changes without departing from the scope of the invention. For example, rather than the tree being the wellhead member that supports the tubing hanger, the tubing hanger could land in the wellhead housing or a tubing spool above the wellhead housing, and the tree installed later. In this case, the wellhead member having the sealing surface and containing the wear bushing would be the wellhead housing or tubing spool. Also, if the cable clamps were small enough to pass through the wear bushing, an operator could make up the total desired length of tubing when first running the pump assembly through the wear bushing. If so, the operator would then attach the retrieval tool to the upper end of the tubing and run the retrieval tool on drill pipe, as explained above. When the wear bushing is retrieved, rather than connecting more strings of tubing, the operator could then attach the tubing hanger, cut and secure the cable to the tubing hanger, and lower the assembly on drill pipe. In that alternate method, the cable would not be fed from the reel through the wear bushing while the wear bushing is supported on the cradle.

The invention claimed is:

1. A method of installing a pump assembly in a subsea well having a tubular wellhead member adjacent the sea floor containing a tubular wear bushing, the pump assembly having an electrical motor that receives power via a power cable, comprising:

(a) lowering the pump assembly on a conduit to a depth in the well at least through the wear bushing in the wellhead member while deploying the power cable alongside the conduit; then (b) connecting a retrieval tool to the conduit, inserting the power cable into a slot in a side wall of the retrieval tool, and lowering the retrieval tool and the pump assembly while deploying more of the power cable until the retrieval tool engages the wear bushing; then (c) lifting the conduit and retrieving the wear bushing with the retrieval tool while taking up the power cable deployed in step (b) until the wear bushing reaches the platform, then disconnecting the retrieval tool from the conduit; and (d) connecting a hanger to the conduit and lowering the hanger and the conduit until the hanger lands in the wellhead member.

2. The method of claim 1, wherein after step (c) and before step (d), running additional conduit into the well and deploying additional power cable alongside the conduit until a total desired length of conduit is reached.

3. The method according to claim 2, wherein the additional power cable being deployed between step (c) and step (d) is fed through a bore of the wear bushing while the wear bushing is supported on the platform.

4. The method according to claim 1, wherein, wherein the pump assembly is lowered sufficiently in step (a) such that it is still below the wellhead member when the retrieval tool reaches the platform in step (c).

5. The method according to claim 1, wherein the conduit is lowered, raised and lowered in steps (b), (c) and (d), respectively, with the use of a string of drill pipe.

6. The method according to claim 1, wherein the steps of deploying the power cable in steps (a) and (b) and taking up the power cable in step (c) are performed with the use of cable reel on the platform.

7. The method according to claim 1, wherein step (d) further comprises connecting an upper end of the power cable to the hanger prior to lowering the hanger.

8. A method of installing a pump assembly in a subsea well having a tubular wellhead member adjacent the sea floor containing a tubular wear bushing to protect a sealing surface within a bore of the wellhead member, the pump assembly having an electrical motor that receives power from a power source via a power cable, comprising:

(a) lowering the pump assembly on a string of tubing from a surface platform at least through the wear bushing in the wellhead member while deploying the power cable alongside the tubing; then (b) connecting a retrieval tool to the tubing, inserting the power cable into a slot in a side wall of the retrieval tool, and lowering the retrieval tool and the tubing while deploying an additional amount of the power cable until the retrieval tool engages the wear bushing; then (c) lifting the tubing and retrieving the wear bushing with the retrieval tool while taking up said additional amount of the power cable until the wear bushing reaches the platform, then disconnecting the retrieval tool from the tubing; and (d) connecting a tubing hanger to the tubing, and lowering the pump assembly again until the tubing hanger lands in the wellhead member.

9. The method according to claim 8, wherein step (c) further comprises placing the wear bushing on the platform, then prior to connecting the tubing hanger to the tubing in step (d), increasing a length of the tubing to a desired total length while deploying more of the power cable through the wear bushing as the wear bushing remains on the platform.

10. The method according to claim 9, wherein placing the wear bushing on the platform comprises placing the wear bushing on a cradle on the platform in an inclined position.

11. The method according to claim 8, wherein the pump assembly is below the wellhead member when the retrieval tool reaches the platform in step (c).

12. The method according to claim 8, wherein step (a) comprises strapping the power cable to the tubing as the tubing is lowered.

13. The method according to claim 8, wherein the tubing is lowered, raised and lowered in steps (b), (c) and (d), respectively, with the use of a string of drill pipe.

14. The method according to claim 8, wherein the steps of deploying the power cable in steps (a) and (b) and taking up the power cable in step (c) are performed with the use of cable reel on the platform.

15. The method according to claim 8, wherein:

the pump assembly is lowered in step (a) by securing lengths of tubing together;

the retrieval tool is lowered in step (b) by securing lengths of drill pipe together;

the retrieval tool is retrieved in step (c) by removing the lengths of drill pipe while lifting the tubing; and the tubing hanger is lowered in step (d) by securing the lengths of drill pipe together again.

16. The method according to claim 8, wherein step (d) further comprises connecting an upper end of the power cable to the tubing hanger.

17. A method of installing a pump assembly in a subsea well having a tubular wellhead member adjacent the sea floor containing a tubular wear bushing to protect a sealing surface within a bore of the wellhead member, the pump assembly having an electrical motor that receives power from a power source via a power cable, comprising:

(a) lowering the pump assembly on a string of production tubing by securing sections of the tubing together at least until the pump assembly is below the wear bushing in the wellhead member, and strapping the power cable alongside the tubing from a reel at the platform; then (b) while the pump assembly is still below the wellhead member, connecting a retrieval tool to the tubing, inserting the power cable into a vertical slot in a side wall of the retrieval tool, and lowering the retrieval tool and the tubing on a string of drill pipe while deploying an additional amount of power cable alongside the drill pipe from the reel until the retrieval tool lands in the wear bushing; then (c) retrieving the wear bushing with the retrieval tool by retrieving the drill pipe while taking up slack of the power cable with the reel until the wear bushing reaches the platform, then disconnecting the retrieval tool from the tubing and supporting the wear bushing adjacent to the reel; then (d) adding more sections of the tubing while deploying additional power cable from the reel and through the wear bushing until reaching a desired length of the tubing; then (e) connecting a tubing hanger to the tubing, cutting the power cable at the reel, and connecting the power cable to the tubing hanger; then (f) lowering the tubing hanger with the string of drill pipe until the tubing hanger lands in the wellhead member, then retrieving the drill pipe.

18. The method according to claim 17, wherein supporting the wear bushing in step (d) comprises placing the wear bushing on a cradle in an inclined position.

19. The method according to claim 17, wherein the power source is located at the wellhead member, and the method further comprising making an electrical engagement between the power cable at the tubing hanger and an electrical contact of the power source.

* * * * *

UNITED STATES PATENT AND TRADEMARK OFFICE

CERTIFICATE OF CORRECTION

PATENT NO. : 7,360,601 B2
APPLICATION NO. : 11/068541
DATED : April 22, 2008
INVENTOR(S) : Boon Sun See It is certified that error appears in the above-identified patent and that said Letters Patent is hereby corrected as shown below:

Column 5, line 61:

delete "wherein;" after "claim 1"

Signed and Sealed this

Twenty-third Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,360,601 B2
APPLICATION NO. : 11/068541
DATED : April 22, 2008
INVENTOR(S) : Boon Sun See It is certified that error appears in the above-identified patent and that said Letters Patent is hereby corrected as shown below:

Column 5, line 61:

delete "wherein;" after "claim 1"

Signed and Sealed this

Seventh Day of October, 2008

JON W. DUDAS
*Director of the United States Patent and Trademark Office*

UNITED STATES PATENT AND TRADEMARK OFFICE

CERTIFICATE OF CORRECTION

PATENT NO. : 7,360,601 B2
APPLICATION NO. : 11/068541
DATED : April 22, 2008
INVENTOR(S) : Boon Sun See It is certified that error appears in the above-identified patent and that said Letters Patent is hereby corrected as shown below:

This certificate vacates the Certificate of Correction issued October 7, 2008. The certificates is a duplicate of the Certificate of Correction issued September 23, 2008. All requested changes were included in the Certificate of Correction issued September 23, 2008.

Signed and Sealed this

Twenty-fifth Day of November, 2008

JON W. DUDAS
*Director of the United States Patent and Trademark Office*